United States Patent [19]

Miettinen

[11] Patent Number: 4,887,521

[45] Date of Patent: Dec. 19, 1989

[54] METHOD FOR ARRANGING OF VENTILATION OF BUILDING AND STRUCTURE FOR APPLYING OF THE METHOD

[76] Inventor: Reino Miettinen, Siilinjärvi, 70900 Toivala, Finland

[21] Appl. No.: 34,154

[22] PCT Filed: Jun. 26, 1988

[86] PCT No.: PCT/FI86/00066

§ 371 Date: Mar. 2, 1987

§ 102(e) Date: Mar. 2, 1987

[87] PCT Pub. No.: WO87/00260

PCT Pub. Date: Jan. 15, 1987

[30] Foreign Application Priority Data

Jul. 3, 1985 [FI] Finland ..... 852623

[51] Int. Cl.[4] ..... F24F 12/00

[52] U.S. Cl. ..... 98/31; 126/431; 126/449; 165/4

[58] Field of Search ..... 98/31; 126/428, 429, 126/430, 431, 449, 436, 400; 165/48.2, 4, 10

[56] References Cited

U.S. PATENT DOCUMENTS

| | | | |
|---|---|---|---|
| 1,131,437 | 3/1915 | Stockmann | 98/31 X |
| 3,376,834 | 4/1968 | Thoren | 98/31 X |
| 3,482,503 | 12/1969 | Jenn | 98/31 X |
| 4,212,292 | 7/1980 | Reinert | 126/428 X |
| 4,232,821 | 11/1980 | Backlund | 126/431 X |
| 4,257,396 | 3/1981 | Reinert | 126/449 X |
| 4,372,373 | 2/1983 | Haugeneder et al. | 98/31 X |

FOREIGN PATENT DOCUMENTS

| | | | |
|---|---|---|---|
| 2261909 | 6/1974 | Fed. Rep. of Germany . | |
| 137562 | 12/1977 | Fed. Rep. of Germany . | |
| 57641 | 9/1975 | Finland . | |
| 63281 | 3/1979 | Finland . | |
| 62725 | 10/1982 | Finland . | |
| 2464440 | 4/1981 | France | 126/449 |

*Primary Examiner*—Harold Joyce

*Attorney, Agent, or Firm*—Cushman, Darby & Cushman

[57] ABSTRACT

Method and apparatus for ventilating a building, in the rooms of which building there is induced a pressure that is different from the outside pressure. Air on one side of the wall of the building is led through openings in the external surface of the wall to the other side of the wall through air permeable insulation materials which are disposed in the wall and is directed by essentially impermeable directing materials which are placed in the wall.

8 Claims, 3 Drawing Sheets

METHOD FOR ARRANGING OF VENTILATION OF BUILDING AND STRUCTURE FOR APPLYING OF THE METHOD

BACKGROUND OF THE INVENTION

1. Field of the Invention

The present invention relates to a method and apparatus for ventilating a building. More particularly, the present invention relates to a method and apparatus for ventilating a building wherein a pressure that is different than the outside pressure is induced in certain rooms of the building.

2. Description of the Prior Art

In most of the buildings in use today it is a problem to secure ventilation of the buildings under all circumstances. Particularly, in buildings to be heated the quality and quantity of the replacing air and the distribution of the replacing air into different rooms is often poor. In air conditioned buildings, the problems are the disadvantages caused by humidification of constructions and the arranging of the ventilation in a reliable way. When endeavouring to heat the replacing air brought in from the outside advantage is not sufficiently taken of the energy contained in the walls.

When using mechanical air-conditioning apparatuses air from the inside of the building is continuously removed and replacing air is brought inside. The replacing air must be either heated or cooled off, depending on the circumstances, prior to introducing it into the room spaces, and into the inlet channels for the replacing air. Different kinds of set-ups are arranged for these purposes. Similarly, air from the room spaces must be removed with the help of different kinds of equipment. These types of tube networks, channels made for the leading of the air, and the cleaning, cooling or heating apparatuses are expensive and bulky, and their mounting, cleaning and maintenance require much time and costs. Additionally, the heat energy contained in the interspace between the ceiling and the roof is not sufficiently taken advantage of for heating the replacing air. One problem is also the costs arising from the air-conditioning operation when using mechanical air-conditioning for bringing-in and removing the air.

SUMMARY OF THE INVENTION

It is an object of the present invention to bring about a method for arranging the ventilation of a building, by which method some above mentioned disadvantages of the present methods are eliminated. In particular, it is an object of the present invention to bring forth a method, which require no expensive tube systems and/or channels for the transport of either replacing or exhaust air. Additionally it is an object of the present invention is to bring forward a method which easy to use and dependable in operation. Further an object of the present invention is to bring about a structure that is favourable to produce and the air-conditioning of which works efficiently and reliably.

According to the invention, air under higher pressure led from one side to the other side of the wall mainly through the air permeable insulating materials of the wall and is directed by means of directing materials, which are essentially less air permeable compared with the insulation materials in the wall. When there is an under-pressure in the room space the air flows through the wall from the outside indoors. Correspondinggly, if there is a positive pressure in the room space, the flowing direction is from the indoors out.

When endeavouring to heat the buildings, the replacing air must be heated before leading it into the room space. In the method according to the present invention the replacing air is led through the wall, when an underpressure is induced in the room space. In this way the replacing air is at the same time heated by the heat energy contained in the wall of the building. The air is led through an opening formed in the outer wall of the building on and is directed by the insulation materials indoors. When using the method of the present invention no particular replacing air channels or heat exchangers are required, because the wall of the building is functioning both as an air channel as a heat exchanger. During the heating season the replacing air is taken mainly through the walls, but during the warm period, e.g. in the summer, the replacing air can be taken in by other manners as well, for instance through windows and ventilation gates. Suitable thermal insulation materials may be used, which at the same time function as purifiers and filters for the replacing air.

Under hot circumstances and for special purposes, for instance in refrigerated warehouses or the like the indoor temperature is endeavoured to be kept lower than the outdoor temperature. When the pressure in the interior spaces of the building is higher than the pressure outdoors, air will escape from the interior space out through the walls of the building as directed by the directing materials. No separate exhaust channels are required for this purpose and at the same time problems arising from humidification are prevented.

With the invention, a simple and efficient air circulation system is achieved, wherein the replacing air is circulated within the materials of the walls of the building until it is sufficiently heated and is thereafter directed into the interior spaces. Correspondingly, during the cooling of the building the exhaust air is circulated within the materials of the walls, whereat the air is heated and the wall is cooled of, until the air is led out. With the help of the directing materials and the air circulation a part of the heat energy penetrating through the walls of the building is recovered during heating and the convection flowing occurring in the walls is prevented. Correspondingly during cooling the wall is cooled off with air coming from the interior spaces.

Materials suitable for use as directing material as known such as for instance plastic, fibreboard, glue layers or the like. The directing material is essentially less air permeable than its insulation material, and holes may be formed therein to change the air permeability properties. The directing material can be chosen from either partly air permeable material or in some applications totally air impermeable material is used.

In one advantageous embodiment, in which in the room spaces is or into there is induced an underpressure, the replacing air is taken mainly through the outer wall of the building inside the wall, is circulated within the interior parts of the wall and is led into the room space mainly from the upper part of the room space. In this way the air is heated during its circulation, but is, however, cooler than the air of the room and it is efficiently mixed with the air of the room. In another embodiment the replacing air is mainly taken in from the lower part of the wall of the building into the wall, is circulated in the interior parts of the wall and led into the room space from its upper part. In this way the air is directed upwardly when warming up and into the inside of the building as a consequence of the underpressure. In the room space it causes circulation and exchange of the air.

In yet another embodiment the replacing air is taken mainly from the upper part of the wall of the building into the inside of the wall, is circulated in the inner parts of the wall and is led in the room space mainly from the upper parts of the room space. In this way the cold replacing air is directed first downwards and at a certain spot upwards inside the wall, whereat an efficient heat transfer from the wall into the replacing air is achieved.

In another embodiment of the present invention, the replacing air is taken both from the upper part and the lower part of the wall, and possibly also from the middle part, into the interior of the wall, is circulated in the inner parts of the wall and is led into the room space mainly from the upper part of the room space. In this way the whole wall can be efficiently taken advantage of as an air-conditioning channel as well as a heat exchanger. In this and in the other applications the replacing air can at least partly be directed to the room space of the building from other spots than from the uppermost part of the room space, but the best result is achieved by leading the replacing air into the upper part of the room space.

In the method of the present invention, the heat in the interspace between the ceiling and the roof is taken advantage of by leading the replacement air into these spaces and from there to the room spaces through the air permeable thermal insulation materials placed in the ceiling. The temperature of these spaces can be 5°–10° C. higher than the outdoor temperature during the winter and with the method this additional heat energy can be taken advantage of.

If the pressure in a room space exists as a positive pressure or if a positive pressure has been induced into a room space, the air flows from the room space into the inside of the wall where it circulates within the inner wall and exists mainly from the lower part of the wall. and at the same time becoming warmer. Hence the temperature of the wall is changing relatively evenly from the inside to the outside and the disadvantages caused by the humidification are prevented. In this application the air can be taken out from the room space through openings arranged in the wall sheathing.

In the method of the present invention the air is taken into the inside of the wall mainly through openings arranged on the exterior or the interior surface of the wall. The exterior and interior surface are formed of directing material which is less air permeable than the insulation material and in some applications of totally impermeable material.

Suitable suitable insulation material, which is for instance thermal insulation material, filtrates impurities from the replacing air and also pre-humidifies the air, whereby the air is healthy and pleasant.

BRIEF DESCRIPTION OF THE DRAWINGS

The present invention is explained in greater detail by referring to the attached drawings, in which.

DETAILED DESCRIPTION OF THE PREFERRED EMBODIMENT

Figure 1:
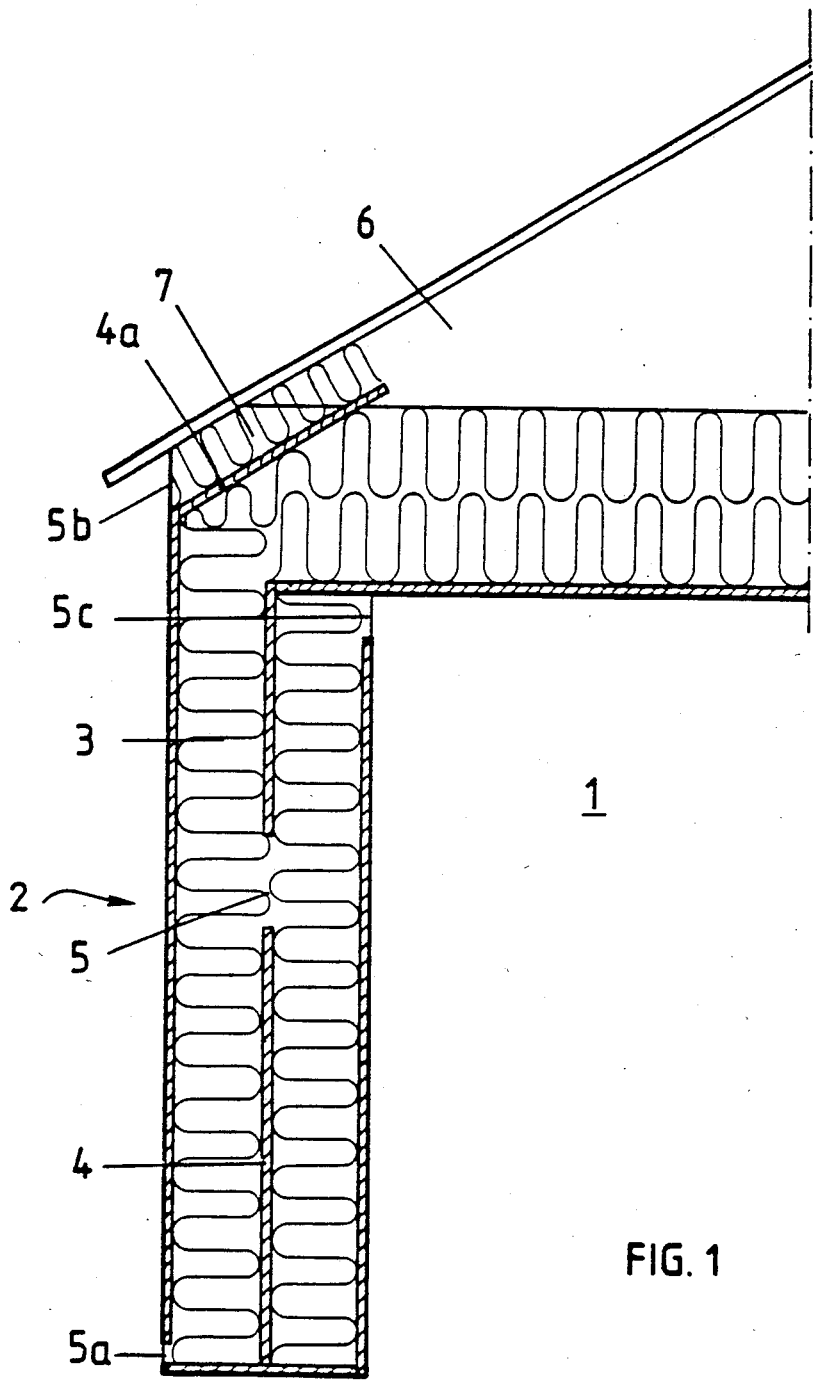
FIG. 1 depicts in the cross-section the walls of a building for applying the ventilating method of the present invention.

Referring to FIG. 1, the walls 2 of a building according to a first embodiment of the present invention contain air permeable thermal insulation materials 3 and air directing materials 4, which are substantially less air permeable than the insulation material 3. The walls of the building are equipped mainly with air impermeable outer surface, in which are formed the openings 5*a*, 5*b* for intaking replacement air. The opening 5*a* is formed in the lower part of the wall and the opening 5*b* in the upper part of the wall. In this embodiment the upper part of the wall is arranged to extend inwardly beneath the roof by the directing material 4*a*, which directs into the attic space through opening 5*b* into a channel 7 which has an air permeable thermal insulation layer situated therein. No other air-conditioning openings are required to be provided for the attic spaces. Within the wall, a section of air directing material is disposed having an opening 5 formed in a central portion thereof. Additionally, the interior side of the wall and the interior ceiling are equipped with air impermeable material. An opening 5*c* is formed in an upper portion of the interior side of the wall. The ceiling is provided with air permeable thermal insulation material. In one embodiment of the present invention, openings may be provided in the directing material which lines the interior ceiling to allow air from the attic space to flow into the room space 1.

In the room space 1 of the building, an under pressure may be induced by mechanical means such as a blower. The replacing air is taken in through the walls, specifically through the openings 5*a* and 5*b*. In all of the disclosed embodiments, when positive pressure exists in room space 1 or is induced thereinto air will flow from the room space 1 outwardly through the passages defined by the directing materials in the opposite direction from that described above. the channel 7 within the attic space 6 passes through the thermal insulation layer of the wall and through the opening 5 to the interior parts of the wall and into the room space through the opening 5*c*. In this way the air can be directed in the wished manner by means of the directing materials and be led into the room space for instance through the base of an illuminator, whereby the heat from the illuminator also heats the incoming air.

Figure 2:
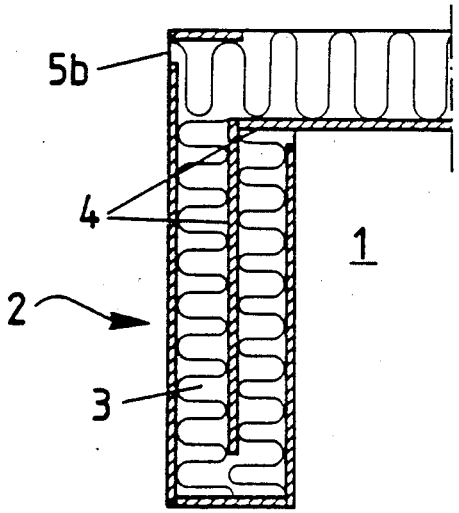
FIG. 2 depicts a second embodiment of a building wall in cross-section for performing a ventilating method according to the present invention.

In FIG. 2, a second embodiment of the present invention is illustrated, wherein outside air is taken in solely through the opening 5*b* in the upper part of the wall. The directing material is in this embodiment arranged to extend from the upper part of the wall close to the lower part of the wall, so that the air is circulated efficiently in the structures of the wall.

Figure 3:
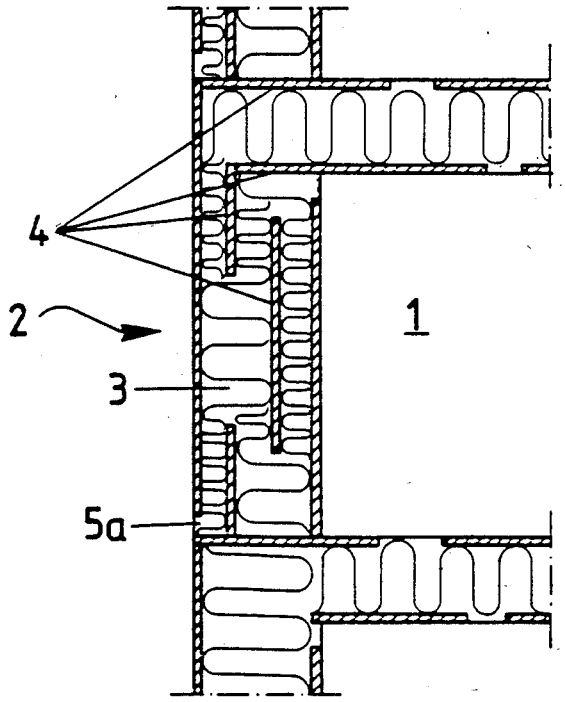
FIG. 3 depicts a third embodiment of the present invention for ventilating between rooms in a building and FIG. 4 depicts a fourth embodiment of a structure of walls according to the present invention.

In the embodiment illustrated in FIG. 3 the replacing air is brought in solely through the opening 5*a* in the lower part of the wall. Several directing material sheets are disposed within the wall for circulating, the air inside the wall.

Figure 4:
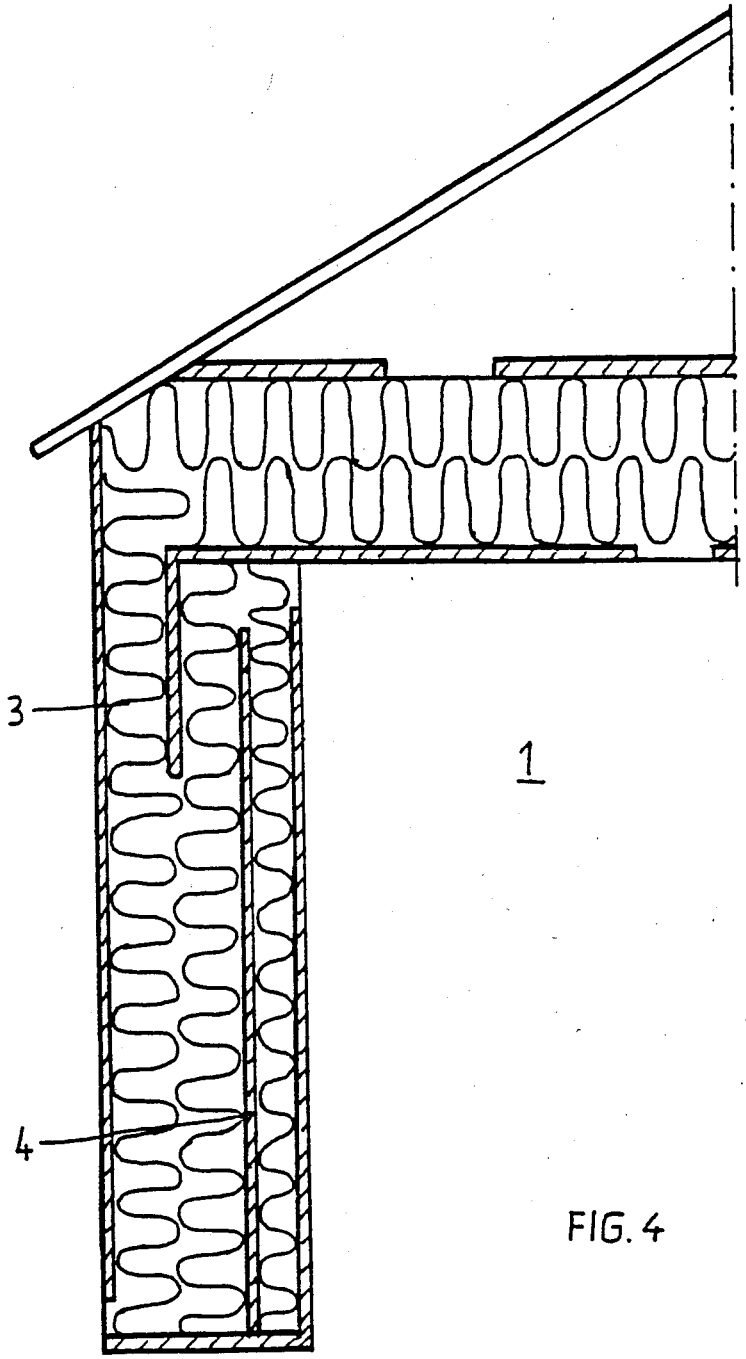

In the embodiment illustrated in FIG. 4, the directing material is placed relatively close to the inner face of the wall. In this way the space between the external surface of the wall and the directing material can be filled with material that is less air permeable or insulation material which can act as an insulation layer. Also the air coming from the attic space is circulated in the interior ceiling and in the wall as directed by the directing materials, as shown in FIG. 4.

In all of the disclosed embodiments, air will flow from the room space 1 outwardly through the passages defined by the directing materials in the opposite direction from that described above. It should be understood that invention is not limited to the disclosed embodiments, but it can vary within the scope of the appended claims. The method is suitable for use while renovating old buildings as well as in building of new ones. The form and the position of the directing sheets according the walls can vary in to the desired air flow pattern. In certain applications only a part of the wall is made use of when taking in the replacing air.

I claim:

1. A method for ventilating a building wherein the air pressure within the building is different than the air pressure outside of the building, comprising:

(a) passing air through an orifice defined on one side of an external wall of the building exposed to ambient atmosphere into a space defined within the wall;

(b) directing the air within the wall in a direction that is parallel to an inner surface of the external wall through insulation materials within the wall by using directing materials which extend parallel to the inner surface of the external wall and have an air permeability of zero to low relative to said insulation materials, thereby filtering the air and providing heat exchange between the air and the wall; and (c) passing the air so filtered through an orifice defined in the opposite side of the wall whereby the filtered air is closer in temperature to the temperature of the insulation materials than was heretofore possible because the air is constrained by the directing materials to move heightwise along the wall prior to exiting same.

2. A method according to claim 1, wherein the directing materials are air impermeable.

3. A method according to claim 1, wherein an under pressure is induced within the building prior to step (a).

4. A method according to claim 2, wherein an under pressure is induced within the building prior to step (a).

5. A method according to claim 1, wherein step (a) further includes the step of passing the air into an interspace between a roof of the building and a ceiling within the building before passing the air into the space defined within the wall.

6. A method according to claim 1, including the additional step of passing air through a second orifice defined on one side of the external wall of the building into an interspace between the roof of the building and a ceiling within the building, and subsequently passing that air into the room spaces of the building through air permeable insulation materials which are located in the ceiling.

7. A method according to claim 1, further comprising the additional step of inducing a positive pressure within a room of the building prior to step (a).

8. Apparatus for ventilating a building wherein the air pressure within the building is different than the air pressure outside the building, comprising:

an external wall of the building having one or more orifices defined in an outer surface exposed to ambient atmosphere and at least one opening defined on an inner surface thereof for allowing ventilating air to pass therethrough;

insulation material within said wall for simultaneously filtering the air and providing heat exchange between the air and said external wall; and one or more sheets of directing materials having an air permeability of zero to low compared to said insulation material and being disposed within said external wall in a direction that is substantially parallel to said inner surface for guiding the ventilating air;

whereby the ventilating air is constrained by the directing materials to flow heightwise along the wall prior to exiting in order to better adjust the filtered air to the temperature of the wall.

* * * * *